US008041577B2

(12) United States Patent
Smaragdis et al.

(10) Patent No.: US 8,041,577 B2
(45) Date of Patent: Oct. 18, 2011

(54) METHOD FOR EXPANDING AUDIO SIGNAL BANDWIDTH

(75) Inventors: Paris Smaragdis, Brookline, MA (US); Bhiksha R. Ramakrishnan, Watertown, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 743 days.

(21) Appl. No.: 11/837,668

(22) Filed: Aug. 13, 2007

(65) Prior Publication Data

US 2009/0048846 A1 Feb. 19, 2009

(51) Int. Cl.
*G10L 19/00* (2006.01)

(52) U.S. Cl. ..... 704/500

(58) Field of Classification Search ..... 704/200, 704/500

See application file for complete search history.

(56) References Cited

U.S. PATENT DOCUMENTS

| | | | | |
|---|---|---|---|---|
| 6,691,083 | B1 * | 2/2004 | Breen | 704/220 |
| 6,704,711 | B2 * | 3/2004 | Gustafsson et al. | 704/258 |
| 6,889,182 | B2 * | 5/2005 | Gustafsson | 704/205 |
| 6,988,066 | B2 * | 1/2006 | Malah | 704/219 |
| 7,181,402 | B2 * | 2/2007 | Jax et al. | 704/500 |
| 7,546,237 | B2 * | 6/2009 | Nongpiur et al. | 704/209 |
| 2003/0050786 | A1 * | 3/2003 | Jax et al. | 704/500 |

* cited by examiner

*Primary Examiner* — Angela A Armstrong
(74) *Attorney, Agent, or Firm* — Dirk Brinkman; Gene Vinokur

(57) ABSTRACT

A method expands a bandwidth of an audio signal by determining a magnitude time-frequency representation $|G(\omega, t)|$ for example audio signals g(t). A set of frequency marginal probabilities $P_G(\omega|z)$ 221 are estimated from $|G(\omega, t)|$, and a magnitude time-frequency representation $|X(\omega, t)|$ is determined from an input signal audio signal x(t). Probabilities $P(z)$, $P_X(z)$ and $P_X(t|z)$ are determined using $P_G(\omega|z)|X(\omega, t)|$. $|\hat{Y}(\omega, t)|$ is reconstructed according to $P_z P_X(z) P_G(\omega|z) P_X(t|z)$, and $|\hat{Y}(\omega, t)|$ is transformed to a time domain to obtain a high-quality output audio signal $\hat{y}(t)$ corresponding to the input audio signal x(t).

10 Claims, 3 Drawing Sheets

METHOD FOR EXPANDING AUDIO SIGNAL BANDWIDTH

FIELD OF THE INVENTION

The invention relates generally processing audio signals, and more particularly to increasing a bandwidth of audio signals.

BACKGROUND OF THE INVENTION

Bandlimited Audio Signals

Increasingly, audio signals, such as pod casts, are transmitted over networks, e.g., cellular networks and the Internet, which degrade the quality of the signals. This is particularly true for networks with suboptimal bandwidths.

Audio signals, such as music, are best appreciated at a full bandwidth. A low frequency response and the presence of high frequency components are universally understood to be elements of high quality audio signals. Quite often though, a wide frequency audio signal is not available.

Often audio signals are sampled at a low rate, thereby losing high frequency information. Audio signals can also undergo processing or distortion, which removes certain frequency regions. The goal of bandwidth expansion is to recover the missing frequency band information.

Most methods attempt to recover missing high frequency components when the signal is sampled at a low rate. However, recovering high frequency data is difficult. Typically, this information is lost and cannot be inferred. The problem of bandwidth expansion has hitherto been considered chiefly in the context of monophonic speech signals.

Typically, the bandwidth of telephonic speech signals only contain frequency components between 300 Hz and about 3500 Hz, the exact frequencies vary for landlines and mobile telephones, but are below 4 kHz in all cases. Bandwidth expansion methods attempt to fill in the frequency components below the lower cutoff and above the upper cutoff, in order to deliver a richer audio signal to the listener. The goal has been primarily that of enriching the perceptual quality of the signal, and not so much high-fidelity reconstruction of the missing frequency bands.

Data Insensitive Methods

The simplest methods for expanding the spectrum of an audio signal apply a memory-less non-linear function, such as a sigmoid function or a rectifier, to the signal, Yasukawa, "Signal Restoration of Broadband Speech using Non-linear Processing," Proceedings of the European Signal Processing Conference (EUSIPCO), pp. 987-990, 1996. That has the property of aliasing low-frequency components into high frequencies.

Synthesized high-frequency components are rendered more natural through spectral shaping and other smoothing methods, and adding the synthetic components back to the original bandlimited signal. Although those methods do not make any explicit assumptions about the signal, they are only effective at extending existing harmonic structures in a signal and are ineffective for broadband sounds such as fricated speech or drums, whose spectral textures at high frequencies different from those at low frequencies.

Example-Driven Methods

The example-driven, approach attempts to derive unobserved frequencies in the audio signal from their statistical dependencies on observed frequencies. These dependencies are variously acquired through codebooks, coupled hidden Markov model (HMM) structures, and Gaussian mixture models (GMM), Enbom et al., "Bandwidth Expansion of Speech based on Vector Quantization (VQ) of Mel Frequency Cepstral Coefficients," Proceedings IEEE Workshop on Speech Coding, pp. 171-173, 1999, Cheng et al., "Statistical Recovery of Wideband Speech from Narrowband Speech," IEEE Trans, on Speech and Audio Processing, Vol, 2, pp. 544-548, October 1994, and Park et al., "Narrowband to Wideband Conversion of Speech using GMM Based Transformation," Proceedings of the IEEE International Conference on Audios, Speech and Signal Processing, pp. 1843-1846, 2000.

The parameters are typically learned from a corpus of parallel broadband and narrow-band recordings. In order to acquire both, the spectral envelope and the finer harmonic structure, the signal is typically represented using linear predictive models that can be extended into unobserved frequencies and excited with the excitation of the original signal itself.

The following U.S. Patent Publications also describe bandwidth expansion: 20070005351 Method and system for bandwidth expansion for voice communications, 20050267741 System and method for enhanced artificial bandwidth expansion, 20040138876 Method and apparatus for artificial bandwidth expansion in speech processing, and 20040064324 Bandwidth expansion using alias modulation.

Limitations of Conventional Methods

Most of the above methods are directed primarily towards monophonic signals such as speech, i.e., audio signals that are generated by a single source and can be expected to exhibit consistency of spectral structures within any analysis frame.

For instance, the signal in any frame of speech includes the contributions of the harmonics of only a single pitch frequency. It may be expected that aliasing through non-linearities can correctly extrapolate this harmonic structure into unobserved frequencies. Similarly, the formant structures evident in the spectral envelopes represent a single underlying phoneme. Hence, it may be expected that one could learn a dictionary of these structures, which can be represented through codebooks, GMMs, etc., from example data, which could thence be used to predict unseen frequency components.

However, on more complex signals such as polyphonic music, which may contain multiple independent spectral structures from multiple sources, those methods are usually less effective for two reasons. Audio signals, such as music, often contain multiple independent harmonic structures. Simple extension of these structures through non-linearities introduces undesirable artifacts, such as spurious spectral peaks at harmonics of beat frequencies. In addition, spectral patterns from the multiple sources can co-occur in a nearly unlimited number of ways in the signal. It is impossible to express all possible combinations of these patterns in a single dictionary. Explicit characterization of individual sources through dictionaries is not practical because every possible combination of entries from these dictionaries must be considered during bandwidth expansion.

Therefore, it is desired to provide bandwidth expansion method that provides quality results for complex polyphonic signals as well as simple monophonic signals.

SUMMARY OF THE INVENTION

The embodiments of the invention provide an example-driven method for recovering wide regions of lost spectral components in band-limited audio signals. A generative spectral model is described. The model enables the extraction of salient information from example audio signals, and then apply this information to enhance the bandwidth of bandlimited audio signals.

In the method, the issue of polyphony is resolved by automatically separating out spectrally consistent components of complex sounds through the use of probabilistic latent component analysis. This enables the invention to expand the frequencies of individual components separately and recombining the components, thereby avoiding the problems of the prior art.

DETAILED DESCRIPTION OF THE PREFERRED EMBODIMENTS

Latent Component Analysis

We use probabilistic latent component analysis (PLCA) to represent a multi-state generalization of a magnitude spectrum of an audio signal. The audio signal is in the form of time series data x(t) with a corresponding time-frequency decomposition X(ω, t). The decomposition can be obtained by a short-time Fourier transform (STFT).

A magnitude of the transform |X(ω, t)| can be interpreted as a scaled version of a two-dimensional probability P(ω, t) representing an allocation of frequencies across time. The marginal probabilities of this distribution along frequency ω and time t represent, respectively, an average spectral magnitude and an energy envelope of the audio signal x(t).

We decompose the probability P(ω, t) into a sum of multiple independent, components:

$$P(\omega,t)=\Sigma_z P(z)P_z(\omega,t),$$

where the probability P(z) is a probabilistic 'weight' of the $z^{th}$ component $P_z(\omega, t)$ in a polyphonic mixture of audio signals. The components $P_z(\omega, t)$ can be entirely characterized by an average spectrum, i.e., the frequency marginal probabilities (ω|z), and the energy envelope, i.e., the time marginal probability P(t|z). This leads to the following decomposition $$P(\omega, t) = \sum_z P(z)P(\omega \mid z)P(t \mid z). \tag{1}$$

EM Algorithm

Equation 1 represents a latent-variable decomposition with probabilistic parameters P(z), P(ω|z) and P(t|z). We approximate these parameters using an expectation-maximization (EM) algorithm. During the E-step, we estimate:

$$R(\omega, t, z) = \frac{P(z)P(\omega \mid z)P(t \mid z)}{\sum_{z'} P(z')P(\omega \mid z')P(t \mid z')}, \tag{2}$$

and during the M-step, we obtain a refined set of estimates:

$$P(z) = \sum_{\forall\omega}\sum_{\forall t} P(\omega, t)R(\omega, t, z) \tag{3}$$

$$P(\omega \mid z) = \frac{\sum_{\forall t} P(\omega, t)R(\omega, t, z)}{P(z)} \tag{4}$$

$$P(t \mid z) = \frac{\sum_{\forall\omega} P(\omega, t)R(\omega, t, z)}{P(z)}. \tag{5}$$

Iterations of the above equations provide good estimates of all the unknown quantities.

Example Spectrogram and Corresponding Frequency Marginal Probabilities

Figure 1:
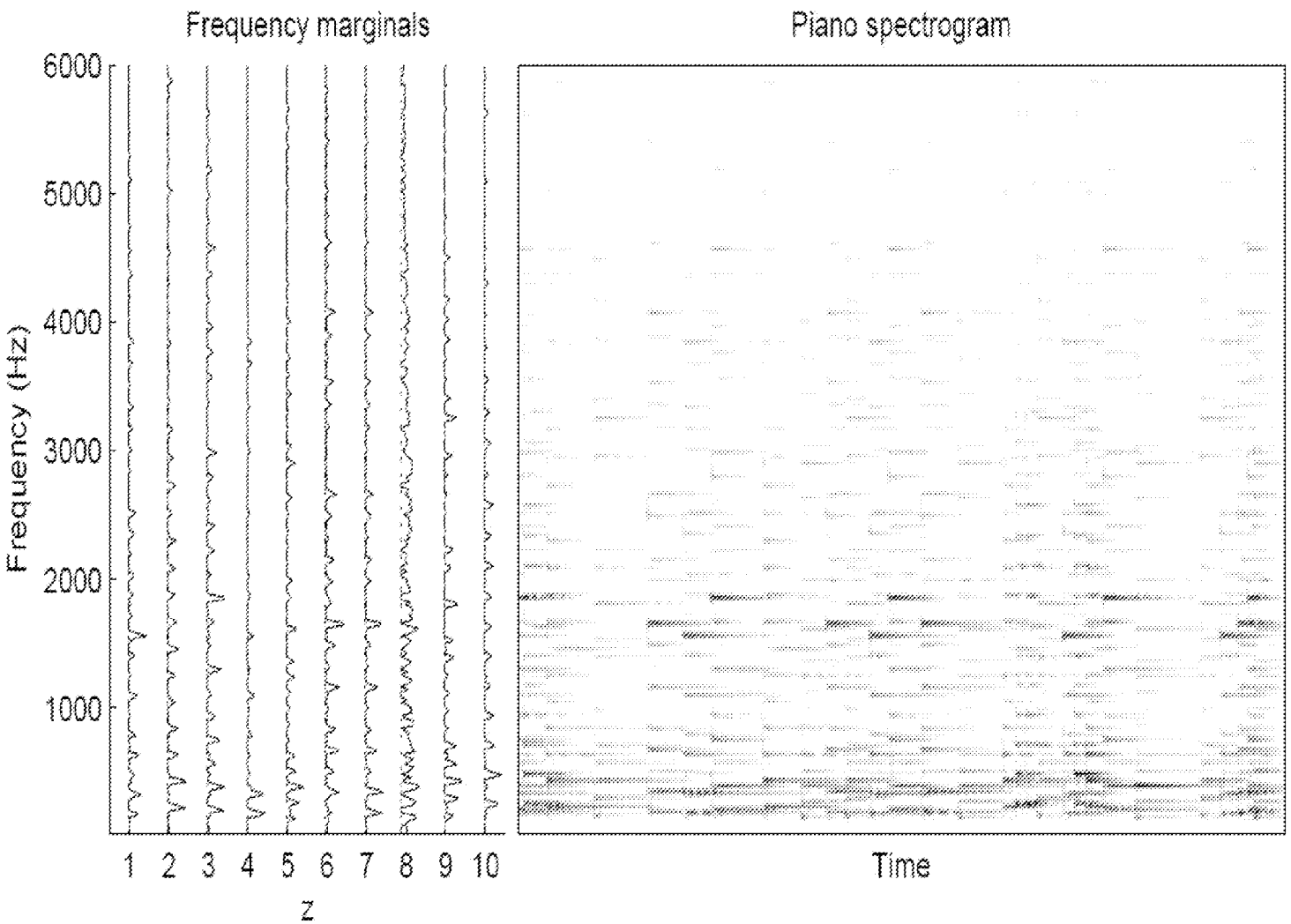
FIG. 1 is a diagram an audio spectrogram and corresponding frequency marginal probabilities.

FIG. 1 shows an example spectrogram of multiple piano notes played at the same time, and the corresponding frequency marginal probabilities P(ω|z) of the frequencies extracted from the spectrogram. The marginal probabilities are a set of magnitude spectra that characterize the various harmonic series in the signal. This type of analysis effectively generates a set of additive dictionary elements that can describe the audio signal. The time marginal probabilities P(t|z) describe how the relative contribution of these dictionary elements change over time, and the prior probabilities P(z) specify the overall contribution of each dictionary element to the signal.

Bandwidth Expansion

As described above, PLCA is very useful in encapsulating the structure of a complex input signal. We use this property to perform bandwidth expansion using an example-based approach.

Bandwidth Expansion Method

Figure 2:
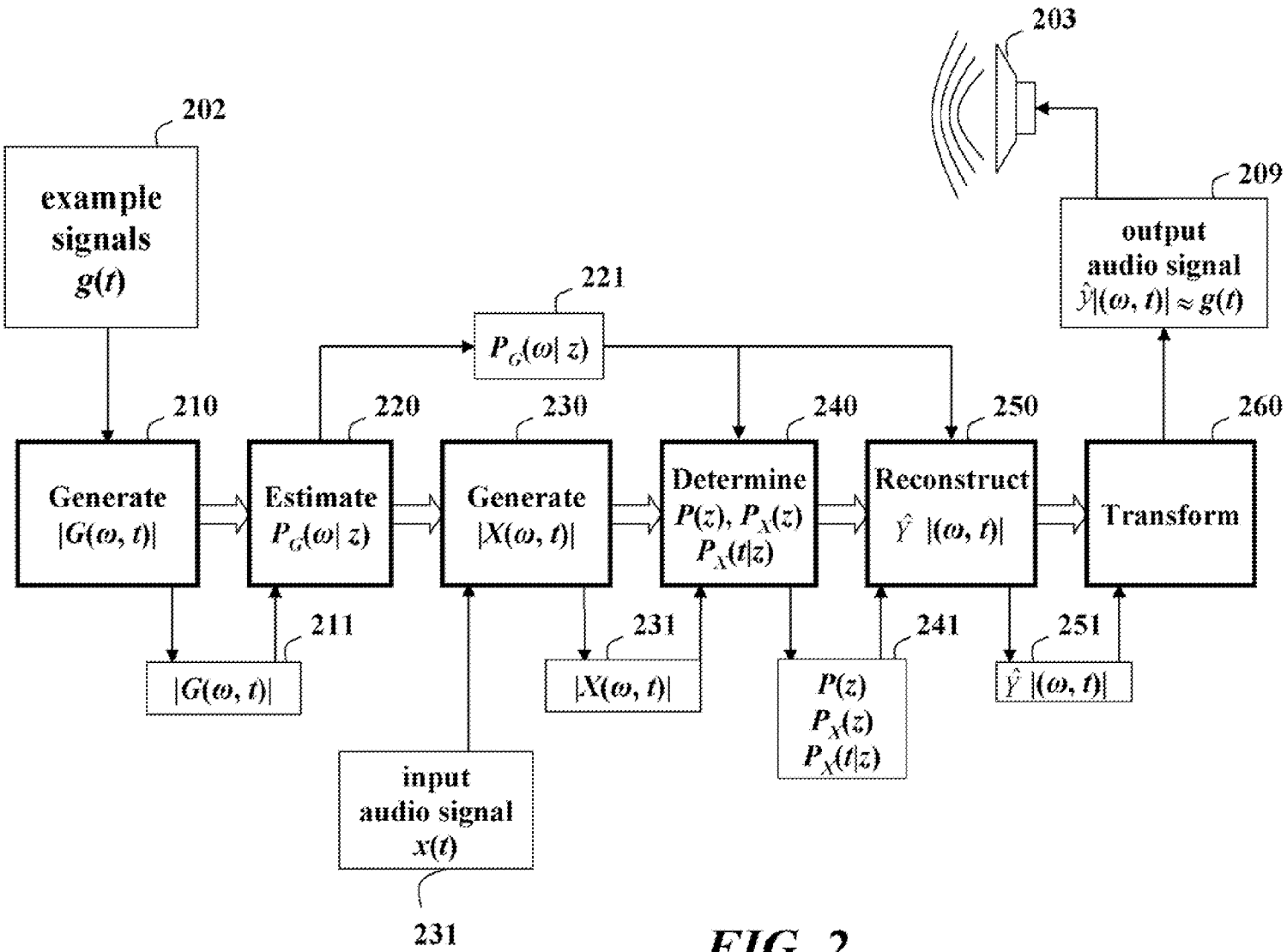
FIG. 2 is a flow diagram of a method for expanding a bandwidth of a bandlimited audio signal according to an embodiment of the invention.

FIG. 2 shows a method for bandwidth expansion according to an embodiment of the invention.

An input audio signal x(t) 231 has arbitrary missing frequency bands. The method produces an output audio signal (t) 209, which is a high-quality signal that is spectrally close to the exact desired result g(t). The output signal can be played back to a user on an output device 203.

We generate 210 |G(ω, t)| 211, a magnitude time-frequency representation of example signals g(t) 202, and estimate 220 a set of frequency marginal probabilities $P_G(\omega|z)$ 221 from |G(ω, t)|.

We generate 230 $|X(\overline{\omega}, t)|$ 230, a magnitude time-frequency representation of the input signal x(t) 231. We use the frequency marginal probabilities $P_G(|z)$ 221 to determine 240 probabilities 241—P(z), $P_X(z)$ and $P_X(t|z)$. We perform the estimation using only the frequencies $\overline{\omega}$, where $|X(\overline{\omega}, t)|$ is significant.

We reconstruct 250 $|\hat{Y}(\omega, t)|=P_z P_X(z)P_G(\omega|z)P_X(t|z)$ 251 to estimate |X(ω, t) using the high-quality frequency marginal probabilities from the high-quality examples 202.

We transform 260 $|\hat{Y}(\omega, t)|$ to the time domain to obtain $\hat{y}(t)$ 209, a high-quality version of the input signal x(t) 201 according to the examples g(t) 202.

Method Details

For the input x(t) signal 101, which has missing frequency bands, we obtain the signal g(t) 202, which serves as an example of what the output signal 209 should sound like, in terms of quality. In the case of speech, we can use a high-quality recording of the speaker. In the case of music, we can use examples of high-quality recordings of music with similar instrumentation.

The magnitude STFT of the low and high quality signals are generated as |X(ω, t)| 231 and |G(ω, t)| 211, respectively.

Using the above EM algorithm, we perform 220 the PLCA of $|G(\omega, t)|$, and extract the set of frequency marginal probabilities $P_G(\omega|z)$ 221. We use a sufficiently large number of components for z, e.g., about 300, to ensure we have an extensive frequency marginal 'dictionary' far this type of signal. $P_G(\omega|z)$ is the set of spectra that additively compose high-quality recordings of the type expressed in g(t).

We use the known high-quality frequency marginal probabilities $P_G(\omega|z)$ 221 to improve the quality of the input signal x(t) 201. The assumption is that the unobserved high-quality version of x(t), i.e., y(t) 209, is composed of very similar dictionary elements g(t). That is, we assume that:

$$|Y(\omega, t)| \approx \sum_z P_Y(z)P_G(\omega|z)P_Y(t|z), \tag{6}$$

and $$|X(\omega, t)| \approx \sum_z P_X(z)P_G(\omega|z)P_X(t|z), \forall \omega \in \Omega, \tag{7}$$

where Ω is the set of available frequency bands of the signal x(t). The probabilities 241, $P_X(z)$ and $P_X(t|z)$, are determined 240 by applying the EM-algorithm to Equations 3 and 5, and fixing $P_G(\omega|z)$ to known values. Because $P_X(z)$ and $PX(t|z)$ are not frequency specific, these probabilities are estimates using only a small subset of the available frequencies.

After $P_X(z)$ and $P_X(t|z)$ are estimated 240, we perform a full-bandwidth reconstruction 250 of our high-quality magnitude spectrogram estimate:

$$|\hat{Y}(\omega, t)| = \sum_z P_X(z)P_G(\omega|z)P_X(t|z). \tag{8}$$

The time transform 260 obtains the time series ŷ(t) 209 $|\hat{Y}(\omega, t)|$ 251. This can be done in a number ways. A direct method uses the estimated high-quality magnitude spectrum $|\hat{Y}(\omega,t)|$ to modulate the original low-quality phase spectrum $\angle X(\omega, t)$, followed by an inverse STFT. A more careful approach manipulates $\angle X(\omega, t)$ appropriately. We can also synthesize the phase spectrum to minimize any phase artifacts.

There are other options for producing ŷ(t). After equation (8), we can perform $|\hat{Y}(\omega, t)|=|X(\omega, t)|$, for all frequencies $\omega \in \Omega$. That is, we retain the original spectrum in all observed frequencies. Alternately, we can use a weighted average of the input signal x(t) of the output signal ŷ(t) to obtain the final result.

Effect of the Invention

Figures 3A, 3B, 3C, 3D:
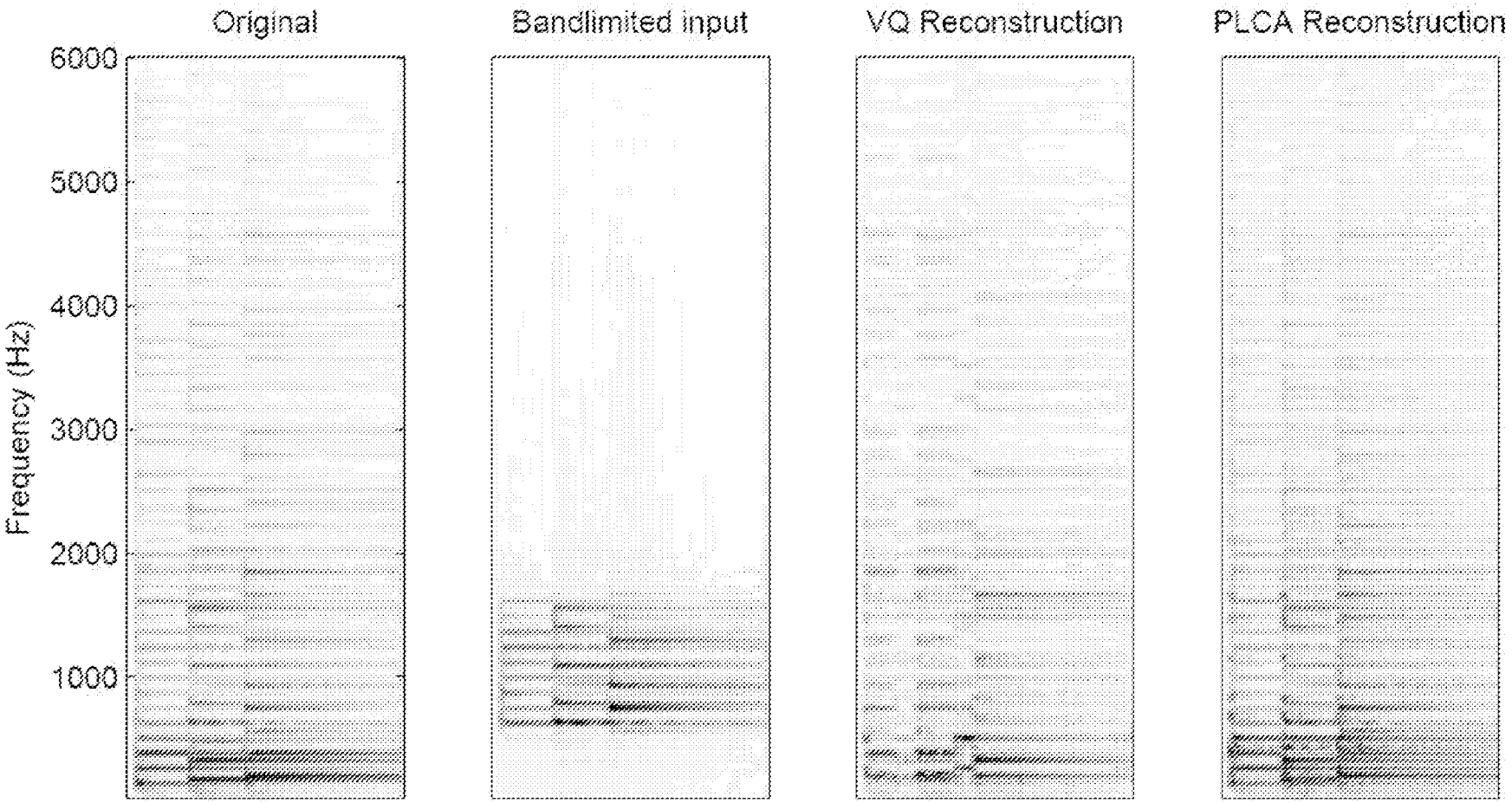
FIGS. 3A-3D compare spectrograms of prior art bandwidth expansion and expansion according to the invention.

FIGS. 3A-3B show the advantages of out method for bandwidth expansion of polyphonic signals. FIG. 3A the original audio signal, a set of three piano notes, which overlap in time. This sound is bandlimited so that the input signal only has energy in a frequency range 650 Hz to 1600 Hz, as shown in FIG. 3B. As an example high-bandwidth sound, we use a recording of the same piano playing various notes.

We extracted a dictionary of about 300 elements using both conventional vector quantization (VQ), see Enbom et al. above, and our PLCA. FIGS. 3C and 3D show the respective VQ and PLCA reconstructions. Models based on VQ cannot perform as well because VQ cannot use multiple elements to describe the additive mixture present in polyphonic sound. Instead, VQ alternates between spectra of individual notes from the training data. The result obtained by VQ has trouble dealing with the overlapping notes because the fitting operation uses a nearest neighbor approach, which cannot combine dictionary elements to approximate the input.

In contrast, PLCA is very effective at selecting multiple dictionary elements to approximate the region with overlapping notes. PLCA produces a superior reconstruction when compared with the conventional VQ model. The ability of our PLCA model to deal with overlapping dictionary elements is what makes the invention the preferred model for complex sound sources such as music.

Conventional bandwidth may be suitable for a monophonic speech signal, where dictionary elements can be used in succession. For more complex polyphonic sound sources, such as music, the dictionary elements are not independently present. This complicates the extraction of an accurate dictionary and the subsequent fitting for the reconstruction. The PLCA model according to our invention is a linear additive model, which does not exhibit any problems in extracting or fitting overlapping dictionary elements. Thus, our PLCA model is better suited for complex polyphonic signals.

We describe an example-based method to generate high-bandwidth versions of low bandwidth audio signals. We use a probabilistic latent variable model for spectral analysis and show its value for extracting and fitting spectral dictionaries from time-frequency distributions. These dictionaries can be used to map high-bandwidth elements to bandlimited audio recordings to generate wideband reconstructions.

When compared to predominantly monophonic techniques, our technique performs well with complex polyphonic signals, such as music, where dictionary elements are often added linearly.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention

We claim:

1. A method for expanding a bandwidth of an audio signal, comprising:

acquiring high quality recordings of an example audio signal g(t) and an input audio signal x(t);

determining a magnitude time-frequency representation $|G(\omega, t)\ t)$ for the example audio signals g(t);

estimating a set of frequency marginal probabilities $P_G(\omega|z)$ from $|G(\omega, t)|$;

determining a magnitude time-frequency representation $|X(\omega, t)|$ of an input audio signal x(t);

determining probabilities P(z), $P_X(z)$ and $P_X(t|z)$ using $P_G(\omega|z)|X(\omega, t)|$, wherein a probability P(z) is a probabilistic weight of a component z of a probability distribution $P(\omega, t)$ of a time-frequency representation of the input audio signal, a probability $P_X(z)$ a probabilistic weight of the component z determined for a significant magnitude time-frequency representation $|X(\omega, t)|$, and a probability $P_X(t|z)$ is a time marginal probability distribution;

reconstructing $|\hat{Y}(\omega, t)|$ according to $P(z)P_X(z)P_G(\omega|z)P_X(t|z)$;

transforming $|\hat{Y}(\omega, t)|$ to a time domain to obtain a high-quality output audio signal ŷ(t) corresponding to the input audio signal x(t), and playing back the high-quality output audio signal ŷ(t) to a user on an output device, wherein x(t) and g(t) are time series data, and t represents time, and in the magnitude time-frequency representation $|G(\omega, t)$, $\omega$ is frequency, and in the set of frequency marginal probabilities $P_G(\omega|z)$, z is a number of frequency components, and a symbol "^" indicates an estimate of the reconstruction.

2. The method of claim 1, in which the determining uses probabilistic latent component analysis (PLCA).

3. The method of claim 2, in which the PLCA uses greater than hundred components.

4. The method of claim 2, in which the PLCA is approximated using an expectation-maximization algorithm.

5. The method of claim 1, in which the example audio signals g(t) correspond to the input signal audio signal x(t).

6. The method of claim 1, in which the input audio signals are polyphonic.

7. The method of claim 6, in which the phase spectrum is minimized.

8. The method of claim 1, in which the transform modulate a phase spectrum $\angle X(\omega, t)$ of $|X(\omega, t)|$ according to $|\hat{Y}(\omega, t)|$ followed by an inverse STFT, wherein "$\angle$" indicates the phase spectrum.

9. The method of claim 1, in which the generating uses a short-time Fourier transform (STFT).

10. The method of claim 1, further comprising:

taking a weighted average of x(t) and $\hat{y}(t)$ to obtain a final result.

* * * * *